US011577944B2

(12) United States Patent
Haley et al.

(10) Patent No.: US 11,577,944 B2
(45) Date of Patent: Feb. 14, 2023

(54) UNIVERSAL LEVEL WIND SYSTEM FOR WINCH ASSEMBLY

(71) Applicant: Woods Hole Oceanographic Institution, Woods Hole, MA (US)

(72) Inventors: James Haley, Woods Hole, MA (US); Joshua Eaton, Woods Hole, MA (US)

( * ) Notice: Subject to any disclaimer, the term of this patent is extended or adjusted under 35 U.S.C. 154(b) by 96 days.

(21) Appl. No.: 16/623,947

(22) PCT Filed: Nov. 6, 2019

(86) PCT No.: PCT/US2019/060072

§ 371 (c)(1),
(2) Date: Dec. 18, 2019

(87) PCT Pub. No.: WO2020/097206

PCT Pub. Date: May 14, 2020

(65) Prior Publication Data

US 2021/0403296 A1 Dec. 30, 2021

Related U.S. Application Data

(60) Provisional application No. 62/756,249, filed on Nov. 6, 2018.

(51) Int. Cl.

| | |
|---|---|
| ***B66D 1/38*** | (2006.01) |
| ***B66D 1/50*** | (2006.01) |
| *B66D 1/26* | (2006.01) |

(52) U.S. Cl.

CPC ..... *B66D 1/38* (2013.01); *B66D 1/50* (2013.01); *B66D 1/26* (2013.01)

(58) Field of Classification Search

CPC ... B66D 1/36; B66D 1/38; B66D 1/48; B66D 1/50; B66D 2700/0191; B65H 75/4407;

(Continued)

(56) References Cited

U.S. PATENT DOCUMENTS 1,763,871 A * 6/1930 Taylor ..... B66D 1/36 242/157.1
1,935,585 A * 11/1933 Tornblom ..... B65H 54/2821 74/37

(Continued)

FOREIGN PATENT DOCUMENTS

CN 107381392 A * 11/2017

*Primary Examiner* — Michael E Gallion
(74) *Attorney, Agent, or Firm* — Cristy M. Salanga

(57) ABSTRACT

A small-footprint level wind system enabling a winch to accept and operate tension members of differing sizes, simplifying the system, and reducing the system weight. Comprising an elongate support, a leadscrew, a guide substantially supported by the support, the guide adapted to accept a tension member. The guide designed to move along the support and to transfer tension member forces onto the support. Further comprising a motor, adapted to apply a motive onto the leadscrew, a shuttle connected the guide and leadscrew and adapted to transfer the motive force to the guide, moving the guide along the support. In many embodiments more than one component share the same longitudinal axis. Another aspect is providing direct tension member metering and load sensing within the guide. Another embodiment provides a load-bearing leadscrew without an additional support, instead having a direct connection between guide and leadscrew.

12 Claims, 4 Drawing Sheets

(58) Field of Classification Search
CPC ..... B65H 54/2851; B65H 54/2866; B65H 2701/33
See application file for complete search history.

(56) References Cited

U.S. PATENT DOCUMENTS

RE20,191 E * 12/1936 Mathey et al. ..... B66D 1/60 102/313
2,473,628 A * 6/1949 Allison ..... B66D 1/36 242/157.1
2,595,655 A * 5/1952 Hannay ..... B65H 75/38 137/355.2
2,639,105 A * 5/1953 Farrar ..... B65H 54/2812 242/397.3
2,660,382 A * 11/1953 Wilson ..... B66D 1/36 242/478.2
2,662,703 A * 12/1953 Brown ..... B66D 1/36 242/397.3
2,900,145 A * 8/1959 Hanson ..... B65H 54/2863 242/478.2
2,904,284 A * 9/1959 Newsom ..... B66D 1/36 242/397.3
2,922,599 A * 1/1960 Bigelow ..... B65H 54/2851 242/157.1
2,941,746 A * 6/1960 Hunt ..... B65H 75/38 242/397.2
2,959,372 A * 11/1960 Sadorf ..... B65H 54/2866 242/483.2
2,988,292 A * 6/1961 Bliss ..... B65H 54/2872 242/478.2
3,118,627 A * 1/1964 Nelson ..... B65H 59/38 242/413.3
3,397,850 A * 8/1968 Anderson ..... B65H 54/2821 242/447.1
3,416,748 A * 12/1968 Bliss ..... B65H 54/2821 242/397.3
3,456,898 A * 7/1969 Anderson ..... B66D 1/36 242/480.8
3,498,567 A * 3/1970 Herbert ..... B65H 54/2851 242/483.3
3,507,458 A * 4/1970 White ..... B65H 54/2872 242/478.2
3,715,084 A * 2/1973 Weiss, Jr. ..... B65H 49/18 242/387
3,809,334 A * 5/1974 Beurer ..... B64D 1/22 242/390.8
3,815,846 A * 6/1974 Biewer ..... B65H 54/2866 242/478.2
3,825,197 A * 7/1974 Sturgeon ..... B65H 59/18 242/419.5
3,829,037 A * 8/1974 Sallin ..... B65H 54/2857 242/483.3
3,951,355 A * 4/1976 Morioka ..... B65H 54/2851 242/478.2
3,994,476 A * 11/1976 van Gennep ..... B66D 5/20 188/134
4,005,834 A * 2/1977 Landreau ..... B65H 75/4407 242/481
4,150,801 A * 4/1979 Ikegami ..... B65H 54/2851 242/478.2
4,151,981 A * 5/1979 Gennep ..... B66D 3/18 254/375
4,179,083 A * 12/1979 Hara ..... B65H 54/2851 242/478.2
4,235,394 A * 11/1980 Fry ..... B65H 75/4407 242/483.3
4,334,670 A * 6/1982 Kawabe ..... B66D 1/16 254/378
4,513,952 A * 4/1985 Vandelinde ..... E04G 3/34 74/68
4,541,584 A * 9/1985 Rivinius ..... B65H 54/283 242/157.1
4,616,791 A * 10/1986 Harvey ..... A01G 25/095 242/397.2
4,695,010 A * 9/1987 Smith ..... B66D 1/38 242/478.2
4,778,121 A * 10/1988 Minnee ..... B66D 1/38 242/157.1
5,330,122 A * 7/1994 Wood ..... B66D 1/38 242/397.3
5,388,781 A * 2/1995 Sauber ..... B65H 54/02 242/390.8
5,823,459 A * 10/1998 York ..... B65H 54/44 242/483.5
6,247,664 B1 * 6/2001 Petersen ..... F16P 3/148 242/484.9
6,443,431 B1 * 9/2002 Stasny ..... B66D 1/38 254/335
6,811,112 B1 * 11/2004 Currie ..... B65H 54/2872 242/548.1
7,419,137 B2 * 9/2008 Boon ..... H02G 11/00 254/323
7,748,685 B2 * 7/2010 Richards ..... E21B 19/22 242/615
7,878,483 B2 * 2/2011 Van Der Laan ..... B66D 1/16 254/365
8,517,348 B2 * 8/2013 Smith ..... B66D 1/38 242/397.3
8,616,529 B2 * 12/2013 Kim ..... B66D 1/50 254/335
9,533,862 B2 * 1/2017 Ho ..... B66D 1/38
9,783,399 B2 * 10/2017 Hausladen ..... B66D 1/30
10,287,147 B1 * 5/2019 Baugh ..... B66D 1/38
10,392,236 B2 * 8/2019 Fordice ..... B66D 1/38
10,662,039 B2 * 5/2020 Cui ..... B66D 1/00
10,889,475 B2 * 1/2021 Haley ..... B66D 1/14
2005/0087644 A1 * 4/2005 Kim ..... B65H 75/4407 242/390.8
2006/0144986 A1 * 7/2006 Tsai ..... B65H 75/4405 242/397.2
2008/0258124 A1 * 10/2008 Farmer ..... B66D 1/00 254/323
2014/0166953 A1 * 6/2014 Wright ..... B66D 1/56 254/270
2015/0266707 A1 * 9/2015 Holmberg ..... B66D 1/48 254/362
2016/0362947 A1 * 12/2016 Baugh ..... E21B 19/008
2016/0362948 A1 * 12/2016 Baugh ..... E21B 19/008
2017/0259941 A1 * 9/2017 Briggs, IV ..... B64C 39/024
2019/0237957 A1 * 8/2019 Kiely ..... H02G 11/02
2021/0009285 A1 * 1/2021 Talke ..... H02G 11/02
2021/0130144 A1 * 5/2021 Haley ..... B66D 1/14

* cited by examiner

UNIVERSAL LEVEL WIND SYSTEM FOR WINCH ASSEMBLY

CROSS-REFERENCE TO RELATED APPLICATION

This application is a national phase filing under 35 USC § 371 of international application No. PCT/US2019/060072 filed on 6 Nov. 2019, which claims priority to U.S. Provisional Application No. 62/756,249 filed Nov. 6, 2018. The entire contents of each of the above-mentioned applications are incorporated herein by reference.

Cross-Reference to Related Publications

This application incorporates the entire contents of the following publications by reference: US 2018/0244507, a National Phase Application of PCT/US16/45466, and US 2016/0167747. The entire contents of the above-mentioned publications are incorporated herein by reference in their entirety.

FIELD OF THE INVENTION

This invention relates to a level wind system for winch assemblies. More particularly, this invention relates to a compact, simplified, single support level wind system. The system described herein provides a single level wind system suitable for use with many differently sized winched cables. And this invention relates to a level wind platform suitable for many different winch assemblies.

BACKGROUND OF THE INVENTION

Winches are hauling or lifting devices that are used to play out, or haul in a length of rope, chain, cable, line or other type of tension member. Winches are used in many fields, including marine environments, cranes, mining, and towing. This instant disclosure focuses on marine winches, however, it is to be understood that the invention described herein is applicable to all winch types and sizes. Winches comprise a rotating drum or reel upon which a line is wrapped. All lines used on a winch are referred generically herein as a "tension member". Proper wrapping of the line is crucial for proper operation of the winch. Line wrapping is the process of adding wraps of lines (i.e. a "line wrap") to the winch drum. A line wrap is a single turn of the line around the drum. Line wraps are added consecutively, from one end of the drum to the other. Once complete, a set of line wraps is referred to as a wrap level. A proper wrap level does not have gaps between line wraps and no two line wraps of a single level are on top of or underneath another. In typical winch operation, as tension member is hauled onto the winch drum, the tension member is added in many wrap layers.

Improper wrapping can result in uneven wrap layers, build-up on the drum sides, and 'diving', where the tension member from one wrap layer is forced down into the layer below it. Uneven forces are applied to the tension member when improperly wrapped tension member is played out, applying unnecessary and dangerous stresses to the tension member and the attached gear. In the best cases, stress forces can damage the tension member, reducing lifetime, result in tangling that stops tension member movement, or damaging the winch motor. In the worse cases, stress forces can snap a tension member, resulting in equipment loss and life-threatening snap-back towards the winch and winch operator.

Commonly known solutions to winch level winding are known in the art, and are exemplified by the many commercially available winch and level wind assemblies on the market. One solution to ensure level winding consists of a screw-like cross member parallel to the drum's longitudinal axis, on which a platform with two rollers traverses from one side of the drum to the other. The screw-like cross member need not be a screw as commonly known, but most often comprises a leadscrew, or diamond screw. For simplicity, the screw-like cross member is referred herein generically as a leadscrew, irrespective of its physical properties. A gap is maintained between the two rollers, typically just bigger than the diameter of the tension member to be wrapped, for example, rollers are spaced 0.575 inches apart when wrapping 0.5 inch line. A computer is used to set leadscrew speed to produce a proper wind wrap.

Another common solution is adapting the screw to a diamond screw, which is a self-reversing screw cut with diamond shaped grooves. The diamond screw turns at the same rate as the winch drum, and the pitch of grooves matches exactly to allow a perfect level wind with the drum. However, one specific diamond screw can only work with one matched drum, and is not universal between differently sized winch drums.

An alternative to rollers is a sheave or diverter mechanism mounted to the cross member. A typical sheave level wind comprises a bearing bolt, or pipe through the center of the sheave, around which the sheave rotates, and the load is born by a weight bearing structure, often multiple pipes or rods situated parallel to the winch drum. Sothcott et al. WO 02/06146 exemplifies such a system, as shown in Sothcott's FIG. 4, the load from the tension member is transferred onto the sheave, and then off onto two parallel rod members, and the leadscrew member, totalling three structural members required to move the level wind across the system. Hanson et al. WO 02/038487 is another exemplification of a common sheave level wind system, where the level wind sheave is bolted to a pivot ring assembly, and moves along the drum by means of two, parallel rods.

Drawbacks in the commonly known level wind systems are, significant. Sheave diverter level winds typically have three structures, two offset supports and a leadscrew. The offset between sheave center and weight-bearing supports introduces a significant moment arm. A moment arm is the length between an axis (e.g. the support) and the force acting on it (e.g. the tension member going through the sheave). The longer the moment arm, the more force that is built up. Moment arms are useful when removing a tight fixture (i.e. with a long-handled wrench), but present a serious problem in the moving, highly stressful environments of a marine winch level wind.

Furthermore, due to their construction, the commonly utilized level wind systems cannot take advantage of benefits of a system situated immediate to the spooling device. Namely, a sheave or guide that moves the tension member onto or off of the spool experiences the actual load of the wire as it moves. When weight-bearing is loaded onto a plurality of supports, the load of the wire cannot be easily measured. Common winch apparatuses use a computational method and overall winch assembly weight (including winch drum, motor, and support super structure) to calculate load. A calculated load is significantly prone to error.

It is therefore desirable to reduce the complexity and forces applied to a winch level wind apparatus, while preserving the level wind functionality. An object of the present invention is to overcome the aforementioned problems, and to further improve the functionality of the level winding and winching system.

SUMMARY OF THE INVENTION

An object of the present invention is to provide an improved level winding system to simplify and reduce the weigh, complexity, and size of the level wind system for winding a tension member about a winch.

Another object of the present invention is providing a level wind system with a single support member, often utilizing a hollow support to reduce complexity of the system. Another object of the present invention is to provide direct tension member metering and load sensing.

This invention features a level wind system for applying a tension member onto a winch, the system including a support, a leadscrew, a guide, a motor, and a shuttle. The motor being connected to the leadscrew and configured to apply a motive force onto the leadscrew. The leadscrew is connected to the shuttle, which is in turn connected to the guide. The shuttle is designed to transfer the motive force from the leadscrew onto the guide. The guide rests on, and is supported by the support, and is configured to (i) move along the support, (ii) receive a tension member, and (iii) transfer any force experienced by the tension member onto the support. The system is further defined by the support being positioned substantially between the leadscrew and the guide.

In some embodiments, the support is at least partially hollow, or has a void in its interior, and the leadscrew is substantially within the support. In some of the preceding embodiments the support further has an opening along its lateral length, allowing the shuttle to connect the leadscrew from within the support to the guide outside the support. In some embodiments, the support shares the same longitudinal axis with the leadscrew. In a set of the preceding embodiments, the guide also shares the same longitudinal axis as the leadscrew and support. In some embodiments, the leadscrew and guide share the same longitudinal axis. In other embodiments, the leadscrew has one longitudinal axis, and the guide and support share a different longitudinal axis.

In some embodiments, the support is divided into two ends on either longitudinal end of the support and these ends are adapted for the system to be mounted onto a winch. In some embodiments, the system further has two flanges, each flange on one longitudinal end of the support and the flanges are adapted to be mounted onto a winch. In some embodiments, the system further includes a controller and a position sensor, where the controller partitions and assigns different regions (i.e. partitions) of the winch drum for different tension members and different operations by the guide.

In one embodiment, the level wind system has no additional supports, and is limited to the single elongate support described above. In some embodiments, the motive force from the motor applied to the leadscrew is rotational, and the leadscrew rotates about its longitudinal axis in response to that motive force.

In some embodiments, the guide further has a first and second portion, the first portion being rigidly connected to the shuttle, and the second portion being moveable about the first portion. In some embodiments, the second portion rotates about the first portion. In additional embodiments, the second portion rotates about the common axis of one of the leadscrew and support. Some embodiments further include a load sensor on or within the first portion of the guide and a controller connected to the load sensor; where the load sensor measures the force experienced by the tension member and applied to the guide, and sends those measurements to the interconnected controller. In some of these embodiments, the load sensor is connected the controller wirelessly, in other embodiments it is connected by a wired-connection.

Some embodiments, the system further includes a metering sensor and a controller, the metering sensor measuring the movement of the second portion, the movement being in response to movement of the tension member, and the metering sensor sends these measurements to the controller.

This invention may also be expressed as a method of winding a tension member about a winch. The method includes the steps of selecting a level wind system including a support, a leadscrew, a guide, a motor, and a shuttle. The motor being connected to the leadscrew and configured to apply a motive force onto the leadscrew. The leadscrew is connected to the shuttle, which is in turn is connected to the guide. The shuttle is designed to transfer the motive force from the leadscrew onto the guide. The guide rests on, and is supported by the support, and is configured to (i) move along the support, (ii) receive a tension member, and (iii) transfer forces experienced by the tension member onto the support. The method includes mounting the level wind system onto a winch, applying a tension member to the guide of the system, and operating the winch to spool the tension member to and from the winch. During operation, the tension member applies a force onto the guide, which is transferred to the support.

In certain embodiments, the method includes the guide further having a first portion, a second portion and a load sensor, where the first portion is fixedly attached to the shuttle, the second portion is movably attached to the first portion and the load sensor being within or on the first portion. The load sensor is adapted to measure the force applied by the tension member onto the guide and directs those measurements to an interconnected controller. In some embodiments, the method includes selecting a system where the support has a longitudinal axis that is shared by the longitudinal axis of the guide. In some embodiments, the method includes selecting a system where the support is substantially hollow and where the leadscrew is substantially within the interior of the support. In some embodiments, the method includes selecting a system where the support shares a longitudinal axis with the leadscrew.

Definitions

The term "tension member" used herein encompasses all types of structures adapted to be spooled by a winch apparatus. Common types and terms such as "line", "cable", "rope", "wire" and "chain" are included as tension members. These terms are typified by a length of approximately cylindrical structure of various make-up. Tension members includes natural and synthetic braded fiber, braded and unbraded metallic wire, multi-layered cables, CTD cables and the like.

The term "drum" as used herein refers to the drum of a winch that accepts a tension member, most often as multiple levels of wrapped tension member. The term drum further includes reels, spools, and other like structures adapted for tension members.

The term "central axis" is used herein to describe the typically longitudinal axis of at least one of the leadscrew, the support member, and the guide. In embodiments where more than one component shares the same central axis (i.e. they are coaxial), the central axis may be referred herein as the "common central axis." In the currently preferred embodiment, the leadscrew, support member and guide all have a single, common central axis.

The term "load sensor" as used herein generically refers to a mechanism that detects a load, pressure, or other stress placed on or between two components. Load sensors are also commonly referred to as "load pins" or "load cells" and these terms are meant to be interchangeable with load sensor. A load sensor detects the force applied across the sensor, often by strain gauges installed within a small bore through the center of the sensor pin; grooves may be machined into the circumference of the pin to define the shear planes, each plane located between the forces to be measured.

The terms "shuttle" and "connection means" as used herein refer to the mechanism by which the guide interacts with the leadscrew and the leadscrew's force (e.g. rotational force) is translated into motion of the guide. The translated motion moves the guide along the support member, parallel to the leadscrew's central axis. The shuttle is also commonly known as a nut, or split nut, ball nut, or follower.

The term "leadscrew" as used herein refers to the linking mechanism that translates a first motion (i.e. rotation) to a second motion (i.e. linear movement). Most often the linking mechanism is a mechanical linkage, embodied by an assembly of connected bodies to manage forces and movements. In the preferred embodiment, the leadscrew is a threaded, elongated cylinder connected to a motor. Here the word elongated is defined as the common adjective form of the word, meaning slender or longer in one, longitudinal dimension than other dimensions. The term leadscrew encompasses other suitable screw-like and non-screw-like mechanisms. For example, the leadscrew may comprise pneumatic or hydraulic actuators, power screws, or translation screws. Common applications include linear actuators, machine slides (e.g. in machine tools), vices, presses, and jacks.

The term "longitudinal" as used herein refers to the lengthwise dimension of a given component. For example, a longitudinal axis as described herein, is the lengthwise axis of a component, for example the elongate support 102, depicted in FIG. 3.

The term "guide" as used herein refers to a diverting mechanism designed to at least partially restrain and to change the direction of a tension member. Most often, the guide receives the tension member from a first direction outside of the system described herein (e.g. a ship's a-frame) and redirects it to the winch drum. The guide moves on an axis parallel to the winch drum's longitudinal axis such that it is positioned to deposit successive portions of a tension member in a level wrap on the winch drum, without creating gaps between tension member wraps, or doubling tension member layers during a single transect between winch drum ends.

The terms "winch" and "winch apparatus" as used herein is defined as any device or mechanical assembly designed to spool or wrap at least one tension member around a rotating drum. Most often winches are used as hauling, lifting or hoisting devices, by attaching a tension member to both the winch and an object to be manipulated.

BRIEF DESCRIPTION OF THE DRAWINGS

In what follows, preferred embodiments of the invention are explained in more detail with reference to the drawings, in which:

FIG. 1A is a schematic side-view of the components, and FIG. 1B illustrates the one dimensional force applied to the support member from the tension member;

FIG. 5A is an angled side view of the guide illustrating the first and second portions as well as the support and opening. FIGS. 5B-5D are side views of the guide illustrating the internal components according to different embodiments.

DETAILED DESCRIPTION OF THE PRESENTLY PREFERRED EMBODIMENTS

Overview

This invention may be accomplished by a level wind system 100 and method of using the same, configured to be used with a winch assembly. The level wind system includes a hollow, elongate support member, a leadscrew, a guide substantially supported by the support member and adapted to (i) move along the support member, (ii) accept a tension member and a force from that tension member, and (iii) transfer the tension member's force to the support member, a motor connected to the leadscrew and adapted to apply a motive force to the leadscrew, and a connection means interconnecting the guide and leadscrew, and adapted to move along the leadscrew along the leadscrew's longitudinal axis in response to the motor's applied force.

Figure 1A:
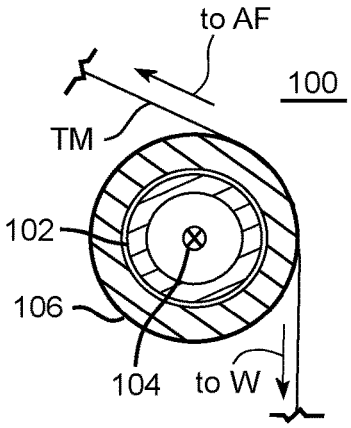
FIGS. 1A and 1B are two side view representations of one embodiment of the present invention.
Figure 1B:
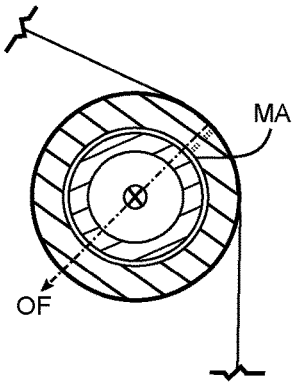

FIGS. 1A and 1B are side view cross-section illustrations of the currently preferred embodiment, having a level wind system 100 comprising a single support member 102, a leadscrew 104, and a guide 106, all having a common central axis 101. A shuttle 116 connects leadscrew 104 to guide 106. The guide 106 is adapted to accept a tension member TM, which typically connects to a winch W and to another object AF, for example an A-frame. The tension member TM will typically experience a force OF as the winch is operated. The tension member's force is transferred onto the guide 106 and then the load-bearing support 102. The resulting overall force OF applied by the tension member TM to the support member 102 is illustrated in FIG. 1B, and is only in one dimension, towards the center of the guide 106, and therefore towards the central axis 101. Due to the system's single, interior support 102, the present invention greatly simplifies the structure of the forces applied to the system 100. Furthermore, the moment arm MA, the distance from the tension member TM to the support 102 is smaller in the present invention as compared to the art. The moment arm MA is depicted as a thick, grey dashed line in FIG. 1B, offset slightly for clarity from the line depicting the overall force OF (black dash-dot arrowed line) from the tension member TM onto the system 100.

The inventive system described herein is contrasted by level wind systems that have a plurality of supports, often two, adjacent to the sheave (i.e. the disclosed guide), and linked to the sheave's axis of rotation by a connector (i.e. the disclosed shuttle). The tension member applies force to the sheave, the connector and the plurality of supports. Due to the location and the fact that there are more than one support, the force from the tension member is applied in a two dimensional manner, in the x and y planes. The cumulative force then acts on each support in a rotational manner.

Figure 2A:
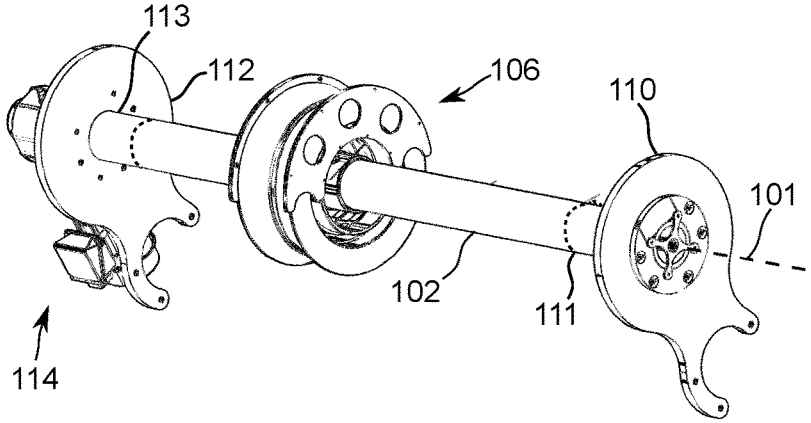
FIGS. 2A and 2B are two, opposing side views of one embodiment of the present invention as it would be suspended above or next to a winch apparatus (not shown)
Figure 2B:
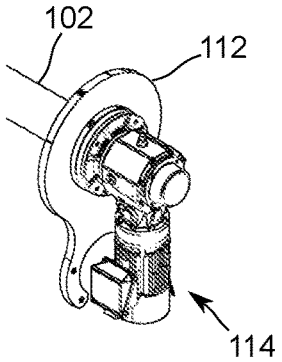

FIGS. 2A and 2B illustrate two views of one embodiment of the present invention. Level wind system 100, has a hollow support 102 supporting guide 106. Two flanges 110, 112 are located on end 111 and 113 of support 102, and are configured to connect the system 100 to the winch W (not pictured for clarity, see FIG. 8). The flanges create separation between system 100 and the winch W, enabling the guide 106 to move parallel to the winch drum WD, prevent guide 106 from leaving the support 102, support the system 100, and enable movement of the entire system out of place, for winch movement and maintenance.

Figure 3:
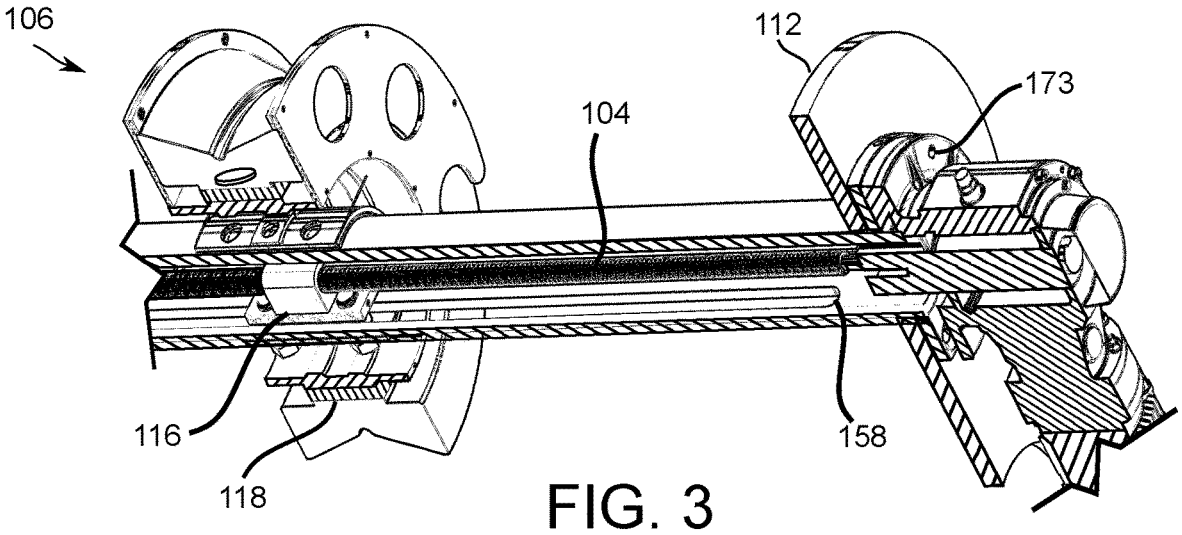
FIG. 3 is a cross-sectional view of the level wind apparatus.

FIG. 3 illustrates a partial cross-sectional view of the currently preferred embodiment. Leadscrew 104 is seen internal to the single hollow support 102, and connected to a motor 114. The motor 114 is configured to affect the leadscrew 104, enabling the guide 106 to move along the support 102. In the currently preferred embodiment, the motor 114 is configured to rotate the leadscrew 104 about its longitudinal axis. A shuttle 116, or connection means (e.g. a nut) is provided inside support 102 and placed onto leadscrew 104, and further connects to guide 106. Shuttle 116 translates the movement of the leadscrew 104 into linear motion, propelling guide 106 along support 102. In the currently preferred embodiment, leadscrew 104, shuttle 116, support 102, and guide 106 all share a common center axis or point. Shuttle 116 on leadscrew 104 imparts the often rotational force of the leadscrew 104 to the guide 106, moving guide 106 along (back and forth) support 102. Also shown in FIG. 3 is a load-transferring mechanism 118, referred herein as bearing 118 that allows for a first, fixed portion 120 and a freely-movable second portion 122 of guide 106.

Figure 4A:
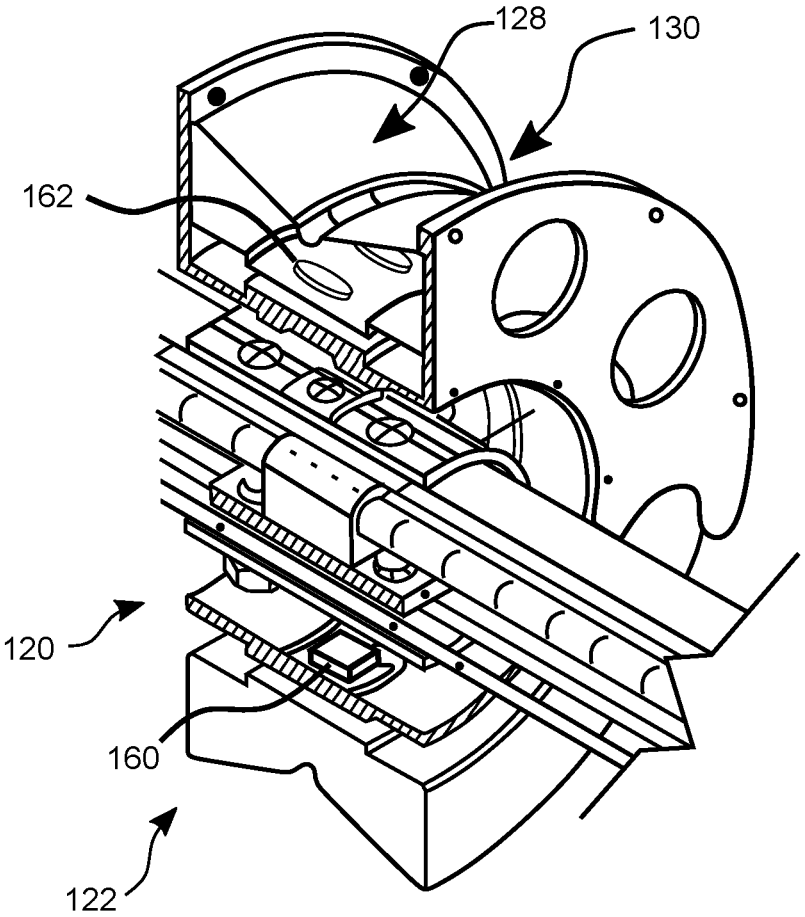
FIG. 4A is a close-up cross-sectional view of FIG. 3, illustrating the internal components of the guide in more detail.
Figure 4B:
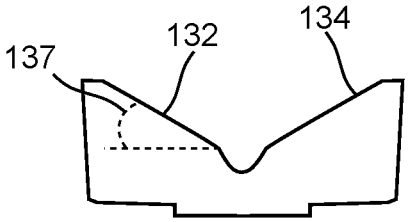
FIGS. 4B-4E are illustrations of the receptacle according to four embodiments.
Figure 4D:
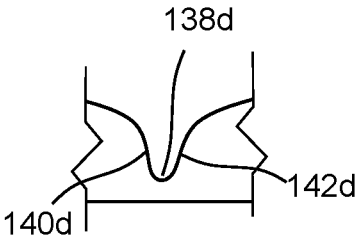
Figure 4C:
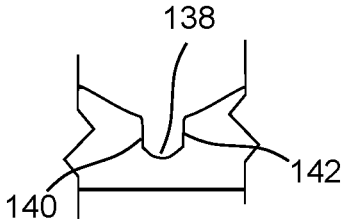

FIG. 4A illustrates a closer view of guide 106 shown in FIG. 3, showing the first portion 120 and the second portion 122. The present invention provides for at least one fixed side-wall member guard 124 (referred herein simply as a guard) typically attached to the first portion 120. The second portion 122 further comprises a receptacle 128, typically V- or U-shaped, for holding and constraining the tension member TM to be sent to or coming from the winch drum WD and another destination (e.g. A-frame) AF. FIGS. 4B-4D show the receptacle 128 in detail and from differing embodiments, each embodiment with different geometry.

Figure 5A:
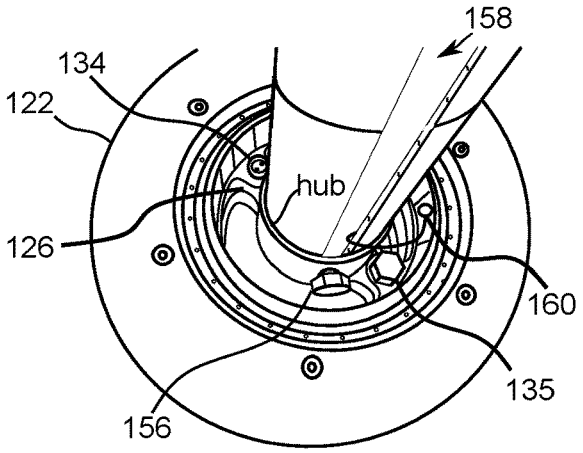
FIGS. 5A-5D are four representations of the guide according to the present invention.
Figure 5B:
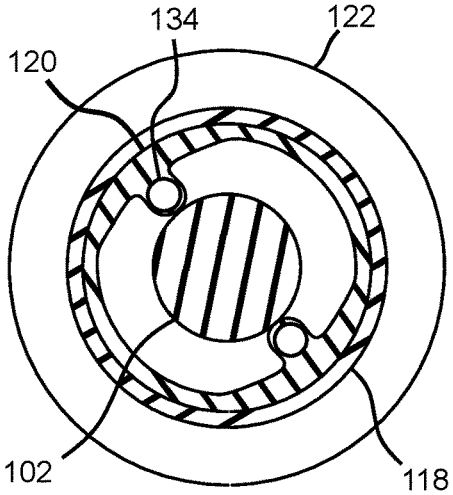
Figure 5C:
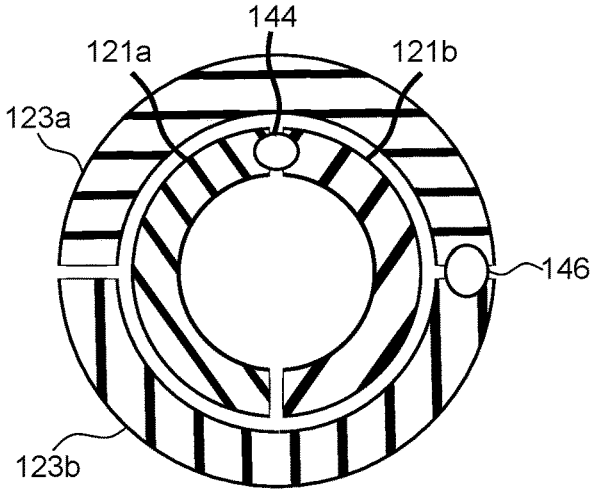
Figure 5D:
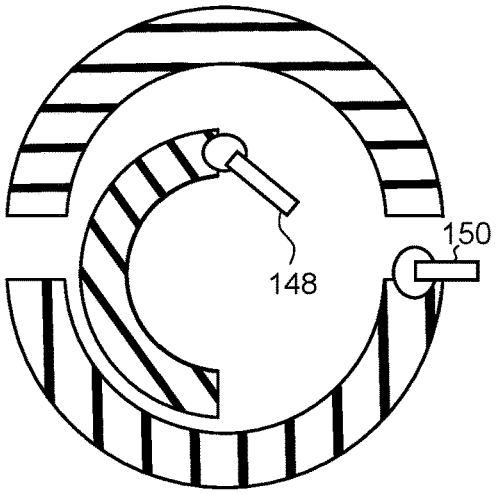
Figure 6A:
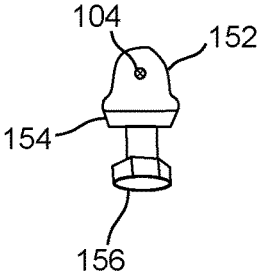
FIGS. 6A-6C are three illustrations of the shuttle and hub of the first portion.
Figure 6B:
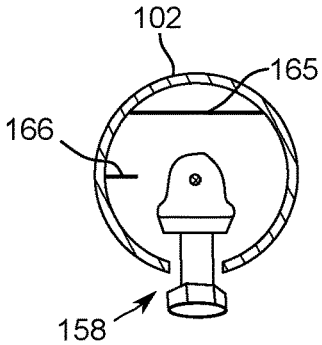
Figure 6C:
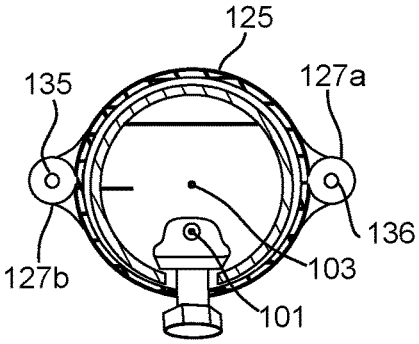
Figure 7:
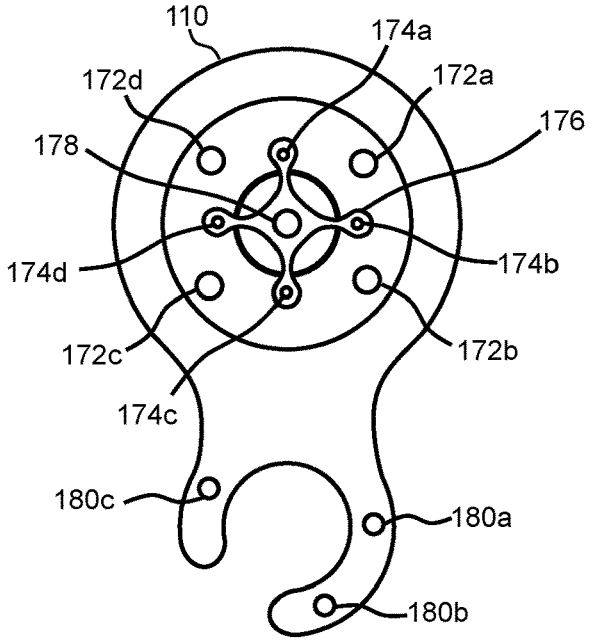
FIG. 7 is an example of a flange according to one embodiment.
Figure 8:
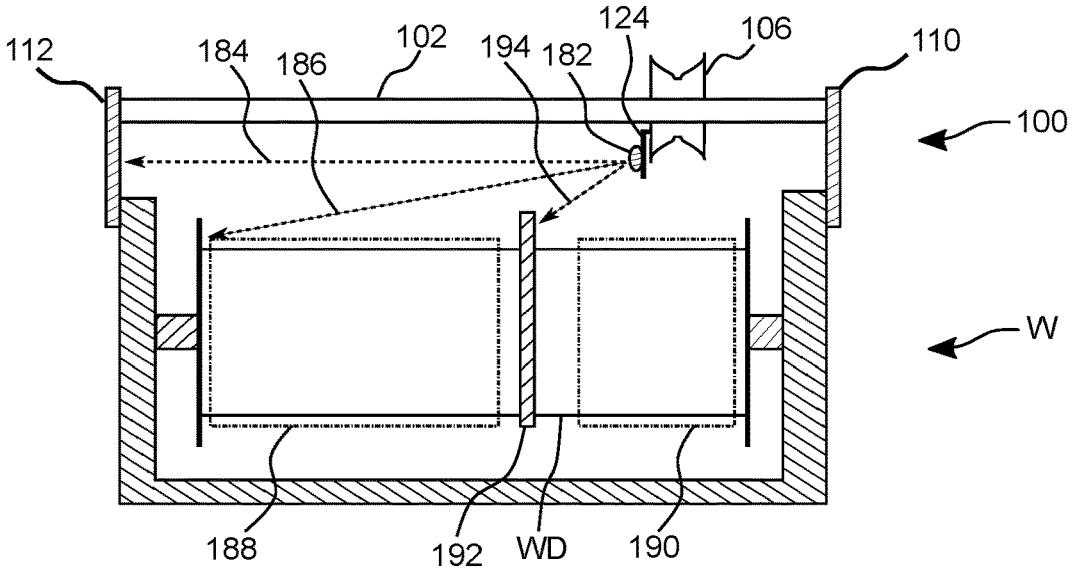
FIG. 8 is an overview, front, cross-sectional view of a winch assembly with a level wind system mounted above the winch; and the level wind system shown including a position sensor enabling partitioning of the winch drum.

FIGS. 5A-5D continue illustrating components of guide 106 according to the present invention. The first portion 120 can be further divided into a hub 125 and carriage 126. Carriage 126 may accommodate a load sensor 134 and is connected to the hub with the load sensor 134 and bolt 135. Carriage 126 is connected to the second portion 122 by bearing 118. FIGS. 5C and 5D illustrate a guide 106 made up of smaller sections. FIG. 6A illustrates the components interior of guide 106, showing the shuttle 152, sled 154, and drive pin 156; while FIGS. 6B and 6C show how these components interact with additional components, including support 102, shelves 165, 166 and the hub components, including hub ear 127, bolt 135 and load sensor 136. FIG. 7 illustrates one example of the various attachment points of a flange 110 of a given embodiment. And FIG. 8 illustrates an overview of a winch apparatus W having one embodiment of the present invention, the embodiment further having a position sensor 182, and winch drum practitioner 192, which along with a controller 164 enable the system 100 to partition the winch drum WD into a first and second partition 188, and 190.

Common Axes

The currently preferred embodiment achieves a reduction of components over currently known level wind systems by sharing a common central axis 101 upon which several of the components are centered (i.e. coaxial). The central axis 101 allow for a single support member 102 to form the structure upon which guide 106 moves along. The central axis 101 can also be thought of as a coaxial axis, where two or more components in the system 100 share a common axis, here the longitudinal axis. Thus in the currently preferred embodiment, at least guide 106, and support 102 form a concentric or substantially concentric, three dimensional form. In other embodiments central axis 101 is not shared by all components. A second longitudinal axis 103 may be defined that is shared by one or more components. For example, as illustrated in FIG. 6C, guide 106 (not shown, instead hub 125 is shown) and support 102 are coaxial on axis 103, while leadscrew defines axis 101.

Guide 106

The present invention provides a guide mechanism 106 that places the tension member TM in proper alignment and condition for placement on the winch drum WD and accepts the forces experienced by the tension member TM to support 102. Unlike guides used in the art, the present guide preferably is coaxial with the support 102, and in some cases the leadscrew 104. The central axis 101 greatly reduces the moment arm MA forces applied to the guide 106 from the tension member TM as the system is operated. Reduced moment arm MA forces reduce the risk of damage to the system during normal operation (e.g. wear and tear) as well as reduce the risk of system 100 and winch W structural damage (e.g. a bent support 102) or collapse in the advent of a tangled or fouled tension member TM. Reduction of the moment arm MA forces further enables the reliance on a single support member 102, as opposed to two or more supports used in the art.

The guide 106 preferably is supported by support 102, and preferably rests substantially on support 102. Typically guide 106 moves along support 102, moving from one end 111 of the support 102 to another end 113, almost always moving end to end of the support 102 multiple times during system operation. The driving force applied to guide 106 will be discussed in more detail below.

First Portion 120

In one embodiment of the current invention, the guide 106 is divided into a first portion 120 and second portion 122.

The first portion 120 is connected to the shuttle 116 and is substantially supported by (e.g. rests on) on support 102. The first portion 120 receives the lateral force provided from shuttle 116 translated from leadscrew 104, resulting in a lateral movement of the entire guide 106 along support 102. The lateral force is defined as a force in the direction of the central axis 101, substantially parallel to the winch drum WD, and along the length of support 102. The first portion 120 is not rotatable, but contains a bearing mechanism 118 on its outer circumferential surface, that is, the surface of the first portion 120 facing or between the first and second portions. Bearing mechanism 118 allows the second portion 122 to freely rotate without movement of the first portion 120 or rotational force transfer to the first portion 120.

The first portion 120, illustrated in FIGS. 5A-5D, can be further divided into a hub 125 and carriage 126, which are fixedly attached to one another. In one embodiment, two attachment points are present, and a bolt 135 and a load sensing mechanism 136, referred herein as the load sensor, connect the hub 125 to carriage 126. In the embodiment illustrated in FIGS. 5A-5B and 6C, hub 125 has physical protrusions accommodating the connection referred herein as hub ears 127*a* and 127*b*.

A guide 106 with a single support 102 also enables direct load force measurement of the tension member TM. The load sensor 136, often a load pin known in the art, receives the forces placed on the second portion 122 by the tension member TM. A load sensor 136 located within the guide 106 provides a novel, and much more accurate load measurement ability over the current method of load calculations based on entire winch assembly W weight.

Second Portion 122

In the currently preferred embodiment, the second portion 122 of guide 106 is configured to rotate freely about the first portion 120, and most often, about the common central axis 101. Rotation ability is provided by bearing 118 between the first and second portions. In the currently preferred embodiment, bearing 118 is a ring bearing as known in the art, preferably a slewing ring bearing. In another embodiment, bearing 118 is a roller bearing. A receptacle 128 accepts and guides the tension member TM through the system 100. In addition, receptacle 128 receives any forces experienced by the tension member TM. The received forces from the tension member TM are transferred to receptacle 108, second portion 122 overall, first portion 120 and finally to support 102.

Figure 4E:
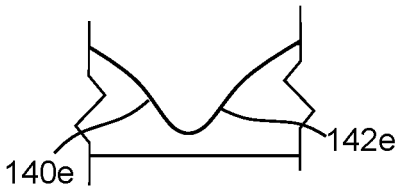

The receptacle 128 has a groove 130, and at least two side walls 132, 134. Several embodiments of the receptacle 128 are shown in more detail in FIGS. 4B-4E. Preferably, the receptacle 128 has slopped side walls 132, 134, such that when equipment attached to or part of tension member passes over the guide 106, the equipment does not catch (e.g. mooring line shackles). Side walls 132, 134 may be any suitable geometry, typically within angle 137 of 30 degrees to 75 degrees above a line parallel with the central axis. Between side walls 132, 134 and typically in the center of receptacle 128 and guide 106 overall, is grove 130. The grove 130 is adapted to accept, or receive, the tension member TM directly, and preferably to restrain it from moving left or right onto a side wall. The grove 130 is of sufficient width to accept at least one sized (i.e. diameter) of tension member TM. Often the grove 130, is of sufficient width to accept several diameters of tension member TM. Most often grove 130 is tapered, being wider at the apex (where it meets side walls 132, 134) than at the base 138. In some embodiments, the groove is 'U' shaped with a rounded base 138 and substantially straight sides 140, 142, as illustrated in FIG. 4C. In the currently preferred embodiment, the base 138*d* of groove 130 is 'U' shaped, but sides 140*d*, 142*d* of the groove are more gently angled away from the vertical, that is shaped as the sides of a 'V' to allow the use of more than one size of tension member TM with one guide 106, as illustrated in FIG. 4D. An alternative to the currently preferred embodiment is illustrated in FIG. 4E, where sides 140*e* and 142*e* are sloped closer to 45 degrees.

Typically, receptacle 128 is about 3 to 8 inches wide. In the currently preferred embodiment, receptacle 128 is 5 inches wide, with a height of 0.5 to 5 inches, preferably 2 inches in height. The shallow nature (larger width than height) of receptacle 128 of the currently preferred embodiment provides system 100 to accept variable diameter tension member TM and attached objects without damage to or fouling of the system 100. Examples of objects attached to a tension member TM that this system 100 is designed to accept without stoppage are the Ocean Observatories Initiative (OOI) Pioneer Offshore Moorings line objects, including shackles, swivels, bushings and sling links.

The guide 106 of the present invention is further interchangeable. The size of the groove 130, receptacle 128 and overall guide 106 is best suited for a single size, or at best, three sizes of tension member TM. Therefore, it is within the scope of the present invention for a plurality of guides, each guide sized for a size or sizes of tension member TM. To remove a guide 106, the currently preferred embodiment further comprises a guide 106 constructed of at least two sections. Both the first portion 120 and second portion 122 may be separated into sections, typically halves, and a mechanical key is used to lock and unlock the sections. The first portion 120 may be assembled from at least two sections, a first section 121*a* a second section 121*b*. Second portion 122 may also be assembled from at least two sections, a third section 123*a* and a fourth section 123*b*. A locking mechanism is located on or between sections and adapted to engage the adjacent section. As illustrated in FIG. 5C, lock 144 is on or between first section 121*a* and second section 121*b* and upon use of key 148 engages and disengages the sections. Likewise lock 146 is on or between third section 123*a* and fourth section 123*b* and upon use of key 150 engages these sections. In some embodiments, locks 144 and 146 use unique keys, while in some embodiments, locks 144 and 146 use an interchangeable key. Some, less preferred embodiments may have more than two sections for one or both of the first and second portions, each section having a lock and key to constrain the sections in place.

To remove a removable guide 106, first any sensors located in the guide 106 are disconnected, then a key 150 is inserted into the second portion's locking mechanism 146, the lock 146 is unlocked and the second portion is removed in its two sections. The key (either key 148 or 150) is entered into first portion 120 and that portion is unlocked and removed in a similar manner.

In further embodiments, guide 106 is not sectioned, but is removed by unbolting the drive pin 156 of shuttle 116, allowing guide 106 to move freely independent of leadscrew 104. Any sensors connected to the guide 106 are disconnected, and then a flange, typically the first flange 110 (without motor 114) is next unbolted and removed. The guide 106 is then slid off support 102 and a new guide, adapted for a differently sized tension member TM, is loaded onto the support member 102.

In additional embodiments, the guide 106 and the second portion 122 may comprise differently shaped means. In some embodiments, the second portion 122 is 'V' shaped with two rigid structures attached to the first portion 120. In other embodiments, the second portion 122 is selected from the list of at least two horizontal rollers, at least two vertical rollers, at least two cogs, an eyelet, and a pulley.

Shuttle 116

The invention provides a mechanism to transfer and convert the movement, or force, of leadscrew 104 into lateral movement of the guide; this mechanism is referred herein as the shuttle 116. In the currently preferred embodiment, shuttle 116 comprises a nut 152 that encompasses leadscrew 104 located substantially at guide 106. A drive pin 156 securely, but reversibly fastens nut 152 to hub 125. Shuttle 116 moves laterally along leadscrew 104 as it is actuated (e.g. turned by the motor in the preferred embodiment). In the currently preferred embodiment, shuttle 116 is fitted such that it passes through an opening 158 in the support member 102. In the embodiment illustrated in FIGS. 6A-6C, nut 152 comprises an additional sled section 154, securely bolted to nut 152. However, in other embodiments, nut 152 and sled 154 are a single physical piece. In other embodiments, shuttle 116 comprises a magnetic connection and the supporting member 102 has no physical opening, instead first portion 120, or guide hub 125 is connected to shuttle 116 by way of electromagnetic or magnetic forces.

Guide Movement Sensor 160

An additional feature of the present invention is the direct measurement of the movement of guide 106. Current winch assemblies W use computational calculations to estimate the amount of tension member TM moved, and therefore the amount of time needed to run the winch before the target depth has been reached during deployment (or amount of tension member TM spooled out). Placing a piece of equipment (e.g. a sensor) or other object at a precise depth can be critical for a mission, especially when that location is near a floor (e.g. seafloor or mine shaft bottom). The present invention provides a guide movement sensor 160, referred herein as the metering sensor, typically within or on guide 106. The metering sensor 160 may comprise any suitable sensing mechanism as known in the art.

In the currently preferred embodiment, the metering sensor 160 comprises a hull effect sensor located on or within the first portion 120. Within the second portion 122 is a readout 162, typically set of magnets, preferably 10 to 20 magnets. The magnets may be in any section of the rotating second portion 122, but most often are located underneath groove 130, in the midpoint of the width of guide 106, as illustrated in FIG. 4A. Metering sensor 160 may be located in any section of the fixed first portion 120, most often at the midpoint of the carriage 126, immediately opposite the set of readout 162 magnets in the second portion 122. The hull effect sensor 160 detects the readout 162 magnets as they pass. The sensor is then connected to a digital control device, referred herein as the controller 164, which calculates guide 106 rotational rate by the rate at which the magnets are detected. In some embodiments, the hull effect sensor is connected to the controller 164 by a wire. In other embodiment, the hull effect sensor wirelessly connects to the controller 164. The present invention, with the metering sensor 160 and load sensor 134 accurately monitors tension member TM metering. Furthermore, with the rotation of the guide 106 being known, it can be compared with the rotation of the winch drum WD. If the drum WD and guide 106 rotate out of the proper ratio, the system can be shut off automatically, protecting against simple to catastrophic faults.

Support Member 102

The presently described inventive system places forces experienced by tension member TM onto a single support member 102. Furthermore, the support 102 and leadscrew 104 are substantially interior to guide 106. In the currently preferred embodiment, support 102 is a hollow, coaxial (to at least leadscrew 104) cylinder-shaped member. In this arrangement, guide 106 is substantially supported by a single support 102 and that support is sufficient to withstand the forces applied guide 106 by tension member TM. The support member 102 most often comprises a hollow interior, enabling leadscrew 104 to fit inside and optionally, allows it to have the same common central axis 101 (coaxial) of support member 102 and guide 106. In embodiments that support 102 is not coaxial with leadscrew 104, support 102 has a second longitudinal axis 103. This axis may be coaxial with other components of system 100, most often guide 106, as illustrated by FIG. 5E. By making the support member hollow, the system if further simplified by necessitating only two attachment points of support 102 to winch W, typically by two supporting flanges 110, 112, and reducing the overall size of the system 100. Support 102 is most often elongate, that is longer in one dimension (i.e. length) than any other dimension (i.e. width and height). An elongate support 102 can be thought of as having end portions 111 and 113 (denoted in FIG. 3 as dotted lines on support 102). Most often ends 111 and 113 are continuous and identical to the remaining portion of support 102. Ends 111 and 113 are ideal sections for attachment of flanges 110, 112 or direct attachment to winch W.

In some embodiments, support member 102 further comprises at least one opening 158 along at least a portion of the support member's longitudinal length. Preferably, opening 158 provides the physical space for shuttle 116 to connect to the first portion 120 of guide 106 to the leadscrew 104. In some embodiments, support 102 further comprises at least one shelf 165, as illustrated in FIGS. 6B and 6C, internal to support 102, but not interfering with the movement of other components (e.g. leadscrew 104 or shuttle 116). Shelves 165 and 166 enable the wiring of sensors, lights or other electronic devices throughout the system 100, as well as to guide 106. Typically shelf 165 enables wires to pass from one end (i.e. where flange 110 attaches) to another, and shelf 166 enables connections to moving shuttle 116 and guide 106.

Figure 1C:
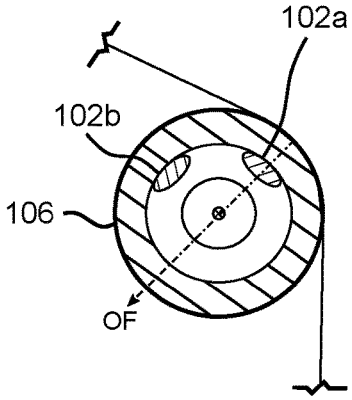
FIG. 1C is a side view representation of a second embodiment of the present invention, comprising two support members, both support members being internal to the guide.

In other, less preferred embodiments, support 102 is not hollow, and comprises a solid piece, or pieces interior to guide 106. These embodiments may comprise additional support members, as long as they are interior to guide 106. The at least first support member 102*a* receives the force applied to guide 106 by tension member TM. As illustrated in FIG. 1C, the cumulative tension member TM force is applied towards the center of guide 106 and first support member 102*a* receives the force. A second support member 102*b* is shown in FIG. 1C, and is interior to guide 106.

In the currently preferred embodiment, support 102 comprises a straight physical piece that is substantially parallel to the winch drum WD. In some embodiments, support 102 and winch drum WD are exactly parallel or almost exactly parallel, such that the distance between the leadscrew and the winch drum does not change along the length of the longitudinal axis.

In the currently preferred embodiment, leadscrew 104 is located substantially within (i.e. interior to) support 102, but leadscrew 104 is not entirely encompassed, an elongate opening 158 is provided to act as a pass through, accepts shuttle 116. This opening 158 exists along the length of support 102. In further embodiments, support 102 only partially encompasses the leadscrew, surrounding leadscrew 104 by at least 25% to 99%.

The level wind system 100 disclosed herein comprises at least one support 102, and the at least one support 102 is interior to guide 106. In additional embodiments, the system further comprises at least a second support member 102*b*, the additional second support 102*b* is also interior to the guide, as illustrated in FIG. 1C. The support members are all interior to guide 106, and while are separate physical structures, they comprise a defined, interior (to the guide) support mechanism, where at least one member receives the force from the tension member TM. The tension member force is transferred from the tension member TM by guide 106 to at least one support member 102 and, if present the at least second support member 102*b*.

Leadscrew 104

The present level winding system 100 relies on a leadscrew mechanism 104 to move guide 106, across support 102, most often parallel to the drum WD. The leadscrew 104 may be any suitable mechanism as known in the art. In the currently preferred embodiment, leadscrew 104 is selected from the commercially available screws, for example an acme screw. The leadscrew 104 is connected to motor 114, such that motor 114 applies a force to leadscrew 104. Typically, leadscrew 104 is rotated to move shuttle 116 and guide 106 along support 102. In these cases, motor 114 turns the leadscrew 104. Typically, the selected leadscrew 104 fits at least substantially within the hollow support 102 with enough clearance for the nut 152 to move freely as motor 114 turns the leadscrew 104. In the currently preferred embodiment, leadscrew 104 is configured to rotate about its longitudinal axis. In the currently preferred embodiment, the leadscrew's longitudinal axis is also the common central axis 101. The leadscrew 104 may be coaxial with guide 106, or coaxial with support 102, as illustrated in FIGS. 1C and 1A, respectively. Alternatively leadscrew 104 may not be coaxial, having axis 101 while support and guide are coaxial, having axis 103, as illustrated in FIG. 6C.

In many embodiments, leadscrew 104 is configured to reverse direction of the attached shuttle 116 (and therefore guide 106) by reversing the direction motor 114 is driven. In other embodiments, leadscrew 104 has a cut pattern such that shuttle 116 reverses at each end of the leadscrew because of the cut. In further embodiments, leadscrew 104 comprises a power screw, as known in the art. In still further embodiments, leadscrew 104 comprises a hydraulic or pneumatic actuator, extending and retracting to move shuttle 116. In these embodiments, leadscrew 104 does not rotate and the force applied to shuttle 116 is linear, not rotational.

Figure 9:
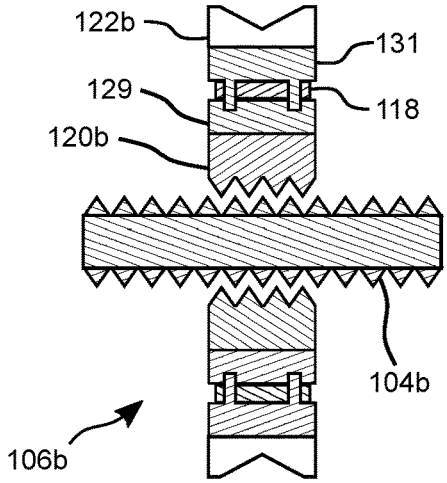
FIG. 9 is a cross-sectional, frontal view of an embodiment having a guide and load-supporting leadscrew and no support member.

In some embodiments, the support 102 and leadscrew 104 are combined, as illustrated in FIG. 9. In these embodiments the leadscrew is load-supporting and additional supports exist, and the combined load-supporting (i.e. load-bearing) leadscrew 104*b* interacts directly with guide 106*b*. The guide 106*b* substantially rests on, and transfers forces onto the load-supporting leadscrew 104. Guide 106*b* in these embodiment further incorporates the shuttle 116 physically into the first portion 120*b*, and has a transmission mechanism 129 that enables the guide's movement along the leadscrew 104*b* from one end to the other at the proper pace, in accordance with the selected tension member TM diameter. The transmission mechanism 129 may be any suitable mechanism as known in the art, including a worm gear, a worm drive, a spur gear, or the like. The load-supporting leadscrew 104*b* may be any suitable actuating mechanism, typically an acme screw or a diamond screw as known in the art. The incorporation of shuttle 116 into first portion 120*b*, most often includes machining teeth or other grasping mechanism, as depicted in FIG. 9 into first portion 120*b* such that it will engage with the load-supporting leadscrew 104*b*. Further, a mechanical metering mechanism 131 may be incorporated into the second portion 122*b* to propel guide 106*b* along leadscrew 104*b*. In these embodiments the mechanical metering mechanism 131 may be in addition to bearing 118, or in replacement of bearing 118. In addition this mechanical metering mechanism 131 may connect to controller 164 and report tension member TM metering.

Flanges

The present invention provides for at least two connections, referred as flanges 110, 112, to support at least support member 102. Typically, the flanges further support leadscrew 104 and motor 114. Additionally, the flanges cap the support 102 and at least one end of the leadscrew 104. The flanges are bolted, or otherwise rigidly fixed to the winch W, such that the level wind system 100 is in a place that allows the tension member TM to be drawn off the drum WD over the guide 106 and to the object AF. In the currently preferred embodiment, flanges 110, 112 position system 100 above the winch assembly W. Preferably, flanges 110, 112 are rigidly and reversibly attached to the winch W, allowing for large forces to be applied to system 100, but still ensuring the ability for removal of system 100. Removal enables maintenance, upkeep or applying system 100 to another winch W. In other embodiments, system 100 is mounted directly to the winch W without separate structural flanges.

Level Wind Attachment Area

At least one of the flanges is reversibly attached to the winch W, to enable removal of system 100 for maintenance and in some embodiments, interchanging guides. For reversible attachment, the flanges 110, 112 can be thought of in two areas: a level wind attachment area 168 and a winch attachment area 170. The level wind attachment area 168 has support member attachment points 172*a-d* and leadscrew linker attachment points 174 (e.g. bolts holes for bolts). The leadscrew linker 176 is a physical piece designed to place the leadscrew 104 at the center point of a hollow support 102, and most often comprises a plate with a leadscrew attachment point 178 in the center that accepts the leadscrew 104, and a plurality of linker attachment points 174*a*-174*d* that attach onto corresponding points on the flange.

At least one flange, shown as flange 112 in FIG. 3, accommodates motor 114 with a plurality of motor attachment points 173, one of which can be seen in FIG. 3. Preferably motor attachment points 173 are adapted to fit into other attachment points of a flange; typically support member attachment points 172. Motor attachment points 173 that line up with other attachment points may then use a single fastener (e.g. a bolt) of simply longer length to connect all of the components.

Winch Attachment Area

The winch attachment area 170 has a plurality of winch attachment points 180*a-c* from the flange to at least the winch W. In the currently preferred embodiment, at least a portion of connection at the winch attachment points 180*a-c* can be disconnected, allowing the level wind system 100 to swing, or otherwise move out of a first, operating position to at least a second position. The first position represents the normal location for level wind operation. The second position allows access to the winch assembly from the previously obscured approach. An example of a useful second position is during normal winch assembly movement, moving the level wind system 100 to one side to allow for easy crane attachment to the winch assembly. The winch assembly would provide additional attachment points at the second position to secure the level wind system 100 while it is in that position (i.e. to avoid damage while moving the winch).

In some embodiments a load sensor (in addition to or in place of load sensor 134) is placed through one winch attachment point 180, to measuring load placed onto the system 100. An embodiment with a load sensor placed between the flange and the winch may be duplicative of the load sensor in the guide, or may replace the load sensor in the guide, in other words the guide would not contain a load sensor.

Motor 114

The level wind system 100 is actuated by a motive mechanism 114. Most often the motive mechanism, referred for simplicity herein as the motor 114, comprises a direct drive electric motor. The motor 114 may be any motive force, as known in the art suited to apply a force from motor 114 onto leadscrew 104, to actuate leadscrew 104 and move guide 106 across the length of support 102.

In the currently preferred embodiment, motor 114 comprises a separate motor unit from the motor that drives the winch W. Typically, motor 114 and the winch motor have a virtual gear ratio, that is for ever turn of the winch drum WD by the winch motor, motor 114 turns leadscrew 104 (and therefore guide 106) a specific distance. As a purely hypothetical example, for every single turn on the winch drum WD, the level wind motor 114 turns ten times, or a 1:10 turn ratio. Thus, controller 164 may command movement of guide 106 according to the turns of the winch drum WD and increase or decrease the amount of movement per winch drum WD turn, to accommodate different tension member TM diameters. For example, when handling 0.322 inch diameter tension member TM, the controller 164 is set to move the guide 0.322 inches for every turn of the winch drum. Likewise, when handling another size of tension member, the guide 106 moves a different distance per drum turn.

Controller 164

The present invention provides for a controlling apparatus to control the system 100, referred herein as the controller 164. In the currently preferred embodiment, controller 164 comprises a winch controlling system as known in the art and controls both the winch apparatus and the level wind system 100. The controller 164 is most often connected to motor 114, the winch motor, the metering sensor 160 and the load sensor 134. Connections are most often wired, and connected as known in the art. Load sensor 134 and metering sensor 160 are wired most often through support 102, and the wiring is secured onto a shelf 166, as illustrate in FIG. 5D. A wire chain or wire carrier retains the wires and allows them to extend and contract with guide 106 as it moves along support 102, without entangling or becoming ensnared in leadscrew 104, nut 152, shuttle 116, or any other component.

As illustrated in FIG. 8, the present invention further provides the ability to detect when guide 106 reaches the side of the winch drum WD, or at another, specific site of the drum WD. In the currently preferred embodiment, guide 106 further comprises a position sensor 182 to measure distance between guide 106 and either one of the end of support 102, flange 110, 112, side of the winch drum WD, or a combination thereof. As illustrated in FIG. 8, arrow 184 depicts position sensor 182 sensing the distance between it and flange 112. Alternatively, or in addition to, arrow 186 depicts position sensor 182 determining the distance to the side of the winch drum WD. Position sensor 182 further allows for controller 164 to assign two or more partitions to the winch drum WD. Each partition may be serviced by the system 100 independently of the other. Each drum partition, areas depicted with dash-dotted lines as winch drum partition 188 and drum partition 190 in FIG. 8 will then accept different types or lengths of tension members, and system 100 may wind each partition in turn. An additional, physical drum divider 192 may be added to the winch drum WD to physically separate the partitions. The position sensor 182 may use the drum divider 192 to determine the proper positions for wrapping each section, as depicted by arrow 194. The position sensor 182 may be used without splitting the winch drum WD into partitions, particularly for determining where guide 106 is in space in relation to the winch drum WD. The position sensor 182 may also inform system 100 when to reverse direction of leadscrew 104, and therefore guide 106.

In one example of the present level wind system, is combined with a winch and winch turntable as described in U.S. Patent publications 2018/0244507 and 2016/0167747, respectfully. Such a winching system enables simultaneous unspooling of one tension member TM from one drum partition 188, while a second tension member TM is spooled onto the winch W on a second drum partition 190. The unspooling tension member TM leaves the drum WD, is guided through guide 106 and off the winch W (often through a ship A-frame AF). In this example, the tension member TM is unspooled from the winch off the stern of the ship. On the opposite side (towards the bow), a user or machine spools a second tension member onto the turning drum WD, while the first tension member is played out. Most often the second tension member is applied by hand, but a second level wind system can be used to get a perfect winding on the drum WD. The second level wind would be connected to the same controller 164 as the winch W and level wind system 100, and built onto a separate support member, most often independent of the winch.

Although specific features of the present invention are shown in some drawings and not in others, this is for convenience only, as each feature may be combined with any or all of the other features in accordance with the invention. While there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature.

It is the intention, therefore, to be limited only as indicated by the scope of the claims appended hereto. Other embodiments will occur to those skilled in the art and are within the following claims.

The aforementioned patent applications US 2018/0244507 (and the PCT application it claims priority to, PCT/US16/45466), US 2016/0167747, WO 02/38487, WO 02/06146 and paper by Mortensen et al. Annals of Glaciology 55(68) 2014, pp.99-104 and any other reference cited herein is each incorporated by reference in their entirety.

What is claimed is:

1. A level wind system for a winch, comprising:

an elongated support;

a leadscrew having a longitudinal axis which defines a first axis;

a guide substantially supported by said support, adapted to (i) move along said support, (ii) receive a tension member, said tension member having a first force and (iii) to transfer said first force to said support;

a motor connected to said leadscrew and adapted to apply a second force onto said leadscrew; and a shuttle connected said guide and leadscrew, and adapted to move along said leadscrew parallel to said first axis in response to said second force; and wherein said support is positioned substantially between said leadscrew and said guide and both said support and said guide are coaxial with said first axis.

2. The system of claim 1 wherein said support is substantially hollow; and wherein said leadscrew is interior of said support.

3. The system of claim 2, wherein said support comprises an opening along at least a portion of the support's longitudinal length, wherein said shuttle connects said guide through said opening.

4. The system of claim 1 wherein said support has a longitudinal axis, which defines a second axis, and said guide is coaxial with said second axis.

5. The system of claim 1 further comprising a controller and a position sensor, wherein said controller is configured to assign the tension member to at least a first and a second partition to the lateral length of the winch drum.

6. The system of claim 1 wherein said second force is rotational, and said leadscrew rotates about said first axis.

7. The system of claim 1 wherein said guide comprises a first and a second portion, said first portion being rigidly connected to said shuttle and said second portion is rotatably connected to said first portion.

8. The system of claim 7 further comprising:

a load sensor, within said first portion; and a controller connected to said load sensor;

wherein said load sensor measures said first force and directs said measurement to said controller.

9. The system of claim 7, further comprising:

a metering sensor; and a controller;

wherein said metering sensor measures a rotation rate of said second portion and directs said measurement to said controller.

10. A method of level winding a tension member about a winch, comprising the steps:

(a) selecting a level wind system comprising a substantially hollow elongate support, a leadscrew interior of said support and having a first longitudinal axis, a guide substantially supported by said support, a motor connected to said leadscrew, adapted to apply a first force onto said leadscrew, and a shuttle connected to said guide and said leadscrew, wherein said shuttle is adapted to move along said leadscrew parallel to said first axis in response to said first force;

(b) mounting said level wind system to a winch;

(c) applying a tension member to said guide;

(d) operating said winch to spool said tension member, wherein said tension member applies a second force to said guide and said guide transfers said second force to said support wherein said support has a second longitudinal axis and said guide is coaxial with said second longitudinal axis.

11. The method of claim 10 wherein said guide comprises:

a first portion being rigidly connected to said shuttle;

a second portion being rotatably connected to said first portion; and a load sensor within said first portion;

wherein said load sensor measures said second force and directs said measurement to an interconnected controller.

12. The method of claim 10 wherein said support is coaxial with said first longitudinal axis.

* * * * *